United States Patent [19]

Schippers et al.

[11] 3,999,715

[45] Dec. 28, 1976

[54] WINDING MACHINE WITH MULTI-CHUCK BOBBIN REVOLVER

[75] Inventors: Heinz Schippers; Erich Lenk, both of Remscheid; Herbert Schiminski, Huckeswagen; Herbert Turk, Remscheid; Manfred Greb, Huckeswagen, all of Germany

[73] Assignee: Barmag Barmer Maschinenfabrik Aktiengesellschaft, Wuppertal, Germany

[22] Filed: Dec. 19, 1974

[21] Appl. No.: 534,648

[30] Foreign Application Priority Data

Dec. 22, 1973 Germany ..... 2364284
Apr. 17, 1974 Germany ..... 2365384

[52] U.S. Cl. ..... 242/18 A; 242/18 R; 242/18 DD

[51] Int. Cl.² ..... B65H 67/04; B65H 54/40

[58] Field of Search ..... 242/18 A, 18 DD, 25 A, 242/18 R

[56] References Cited

UNITED STATES PATENTS

| | | | |
|---|---|---|---|
| 3,559,902 | 2/1971 | Brock | 242/18 A |
| 3,825,206 | 7/1974 | Schippers et al. | 242/18 A |
| 3,841,574 | 10/1974 | Lenk et al. | 242/18 DD |
| 3,856,222 | 12/1974 | Wust | 242/18 A |
| 3,861,607 | 1/1975 | Schippers et al. | 242/18 DD |

FOREIGN PATENTS OR APPLICATIONS

| | | | |
|---|---|---|---|
| 17,741 | 1907 | United Kingdom | 242/18 DD |

*Primary Examiner*—Stanley N. Gilreath
*Attorney, Agent, or Firm*—Johnston, Keil, Thompson & Shurtleff

[57] ABSTRACT

A winding machine comprising a traversing mechanism, a yarn-contact roller acting as a measuring and/or drive roller and adapted to be brought into contact with the winding tube or bobbin, and a bobbin revolver which is adapted to be rotated and locked in position and on which are mounted for rotation at least two tube chucks which are alternately brought into friction contact with the contact roller in a bobbin-changing position.

22 Claims, 15 Drawing Figures

WINDING MACHINE WITH MULTI-CHUCK BOBBIN REVOLVER

Winding machines equipped with bobbin revolvers are known, for example from DL-Patent No. 46,651 and German Offenlegungsschrift No. 2,110,367. In bobbin machines of this kind equipped with bobbin revolvers, the bobbins can be changed with virtually no losses, in other words the full package is replaced by an empty tube in such a short time as to minimize or eliminate altogether production losses during bobbin change. This problem arises in particular in spinning machines, spinning and drawing machines and other mechines in which synethetic filaments are processed at high, constant speeds so that, with only a short winding cyclè (the time required to produce a finished, i.e., full package), bobbin change (replacing the finished package with an empty tube), has to be carried out at frequent intervals without interfering with the continuity of production.

At least two chunks are mounted for rotation on the so-called bobbin revolver. The bobbin revolver is connected to a drive motor (revolver drive) by which it can be rotated. The bobbin revolver is lockable in predetermined positions by a locking mechanism. The positions are predetermined in such a way that one of the chunks with the tube mounted on it moves into the effective range of the contact roller. Suitable chucks are described, for example, in German Offenlegungsschrift No. 2,106,493.

During the winding cycle, the contact roller is in friction contact initially with the tube and subsequently with the package being built up on the tube. The main function of the contact roller is to keep the peripheral speed of the growing package at a constant level. The peripheral speed is essentially the geometric sum of the constant rate of travel of the filament and the mean trafersing speed. The contact roller can be connected to a synchronous motor as its drive motor. In this case, the contact roller acts as a drive roller for peripherally driving the package, while the chucks are mounted for free rotation in the bobbin revolver. Alternatively the bobbin revolver fears axle drive motors for each chuck. In this case, the contact roller acts as a measuring roller for measuring the peripheral speed of thickness of the package, and is connected to a regulating system for adapting the rotational speed of the package to the increasing diameter thereof (cf. German Patent No. 1,115,815). Other known winding machines, although comprising an axle drive motor for the package, are also provided with a drive roller which is driven at a constant speed of rotation and whose drive moment is kept substantially constant throughout the entire winding cylce (German Patent No. 1,267,780).

A relative movement between the chuck in its working position and the contact roller is possible in a direction perpendicular to the axes, whether through travel of the contact roller, through travel of the bobbin revolver or through pivoting of the bobbin revolver.

In winding machines of the kind described above, bobbin change can only be carried out without losses if the empty tube ready for winding is brought to a peripheral speed substantially corresponding to the rate of filament travel before the filament is applied to it. To this end, German Offenlegungsschrift No. 2,110,367 provides an auxiliary drive which acts on the chuck with the empty tube while it is still in its rest position.

According to DL-Patent No. 56 651, the empty tube is brought into friction contact with the drive roller by rotating the bobbin revolver while the full package in the process of winding is still in contact with the drive roller. Only when the filament is applied to the empty tube is it separated from the full package and the bobbin revolver rotated through such an angle that the empty tube moves into the working position and the full package into the rest positon where it is slowed down, removed and replaced by an empty tube. This is a simple and effective way of changing bobbins without any losses. Unfortunately, this known arrangement is attended by the disadvantage that the contact roller has to have a very large diameter if the possibility of changing bobbins without losses in the winding machine is not to be seriously limited, because, in the event of a break in the filament travelling at a high, constant speed, bobbin change has to be carried out again, even if the tube in the process of winding is covered with only a few layers of filament or even if only the tail or waste winding has been wound on to it. In this case, the contact roller can only be brought into friction contact with the almost empty tube affected by the break and the new, empty tube which will take its place in the winding cycle, if the diameter of the contact roller is adequate. The diameter of the drive roller has to be large enough to ensure that, even in cases where two empty tubes are in contact with it at the same time, no excessive contact pressure arises through the torque which has to be applied to start up the empty tube. Unfortunately, this large diameter of the contact roller has numerous disadvantages because it is very much an obstacle to pivoting of the bobbin revolver with a full package, and necessitates a winding machine of large dimension.

An object of the present invention is to obviate these disadvantages and, in particular, to provide a winding machine equipped with a bobbin revolver in which there is no geometric dependence between the diameter of the drive roller on the one hand and the interval between the tube chucks to be serviced in succession and the package diameter on the other.

According to the invention there is provided a winding machine comprising a traversing system, two contact rollers, each acting as a measuring and/or drive roller and adapted to be brought into friction contact with the periphery of the winding tube or package, a rotatable bobbin revolver on which are rotatably mounted at least two tube chucks which are brought alternately into friction contact with a contact roller and into a bobbin changing or rest position, and an independent measuring and/or drive system for each of the contact rollers, the machine being such that a chuck with an at least substantially full tube mounted on it can be brought into friction contact with the first contact roller while, at the same time, a chuck with an empty tube mounted on it can be brought into friction contact with the second contact roller.

An advantage of this winding machine is that both contact rollers have an extremely small diameter and can be arranged relative to one another in such a way that the winding machine as a whole can be built with very small dimensions. Another advantage of the winding machine, especially in cases where it is used in synthetic fibre spinning installations, is that, during bobbin change, different peripheral speeds can be adjusted as required for the full packages and empty tubes by driving the contact rollers at different rotational speeds. In this way, the tension of the filament on the empty tube and, hence, the particularly important hardness of the first layers of yarn, can be adjusted as required independently of the tension of the filament on the full package. During the winding cycle, i.e., when the bobbin revolver moves into its working position so that the tube or package in the process of winding is no longer in friction contact with the second contact roller, but instead is in friction contact with the first contact roller, the independently adjustable speed of the contact roller can be used with advantage to transport or slow down the filament resting on it and, hence, to influence the tension of the filament running on to the package. Another advantage, especially in cases where bobbin change is automatic, is that even if the contact rollers only have small diameters the interval between the chuck axes can be so great that there is no danger of mutual contact between the package in the process of winding and the finished package. In this way, no time is lost in removing the full package.

In one embodiment of the invention, a ring which cooperates with one end of the chuck or of the empty tube to be mounted thereon and which is larger in diameter than either is provided on the second contact roller. This ring enables the filaments to be delivered without damage between the second contact roller and the empty tube in contact with it to the as yet not quite full package without any break in the continuity of the traversing movement.

Alternatively a ring may be fitted in one end of the chuck to cooperate with the second contact roller. Alternatively, the second contact roller can be provide for the same purpose with endless filament guide grooves. This ensures that the filament is able to travel unimpeded on to the package in the process of winding while, at the same time, being traversed, even if an empty tube is in contact with the second contact roller. It also affords the advantage that the filament is traversed as close as possible to the surface of the package, thus guaranteeing an exact package structure. This embodiment also enables the second contact roller to be adjusted not only to a higher or lower speed, but also to a periodically fluctuating speed, independently of the first contact roller, when the bobbin revolver is rotated into its working position, taking the tube or package in the process of winding out of friction contact with the second contact roller and bringing it into friction contact with the first contact roller. Accordingly, it is possible in this embodiment of the invention to influence filament tension and, in addition, the angle at which the filament is laid on the package during the winding cycle by speeding up or slowing down the second contact roller, to avoid so-called "mirror" formation during that part of the winding cycle which is particularly prone to this phenomenon by periodically altering the desired rotational speed of the contact roller, to carry out bobbin change without any losses and, at the same time, to use the traversing system, i.e., the second contact roller in the form of a grooved cylinder, briefly for synchronizing the peripheral speed of the empty tube, and also to adjust different peripheral speeds for the empty tube and for the full package during application of the filament.

It is possible in accordance with the invention for the desired peripheral speeds of the first and second contact rollers to be synchronized as required or adjusted to a certain ratio. To this end, the desired speeds can be adjusted accordingly, for example by switching the frequency of synchronous motors. Alternatively, a transmission link with a certain transmission ratio, in the form of a clutch, can be provided between the two contact rollers. This transmission link is preferably in the form of an overriding clutch which can be brought into operation by reducing the rotational speed or driving power of the faster contact roller. The advantage of this embodiment is that sudden changes in filament tension during changeover of the package in the process of winding from one contact roller to the other are avoided.

In a preferred embodiment means are provided for compensating the torque produced by the weight of the package on the bobbin revolver and preventing undesirable rotation of the bobbin revolver under the effect of that torque.

Accordingly, in this embodiment the contact rollers are carried by a substantially vertically displaceable carriage, and the machine has at least one cam surface and at least one roller which are associated with the bobbin revolver and the machine frame and which support one another under the adjustable effect of a power store in such a way that a peripheral force offsetting at least some of the weight of the full package is applied to the bobbin revolver when a full package and an empty tube are simultaneously in contact with the contact rollers.

This embodiment of the invention makes a considerable contribution towards ensuring that, during a bobbin-changing operation, the filament is transferred from the completed package to the new empty tube without any losses. It prevents the contact pressure between the empty tube and the contact roller from becoming too great or even the carriage carrying the contact roller from being pushed away, as a result of which contact between the driving roller and the full package would be completely and prematurely lost, the full package would not be driven for long enough and, hence, bobbin change would not be carried out in the proper manner.

It is frequently desirable or even necessary for packages varying in weight and diameter to be able to be wound on one and the same winding machine. Different package weights give rise to different torques, while different package diameters give rise to different angular positions of the bobbin revolver relative to the contact rollers during the bobbin-changing or filament-changing operation. This means that it is desirable to be able to exert peripheral forces differing in intensity in dependence upon the particular package diameter.

This requirement can be satisfied by suitably designing the cam surface. Taking into account the design of the bobbin revolver, it is possible by intermittently monitoring the continuous change in package weight and the relative movement between the bobbin revolver and the fixed machine frame, to formulate parameters for establishing a curvature for the cam surface such that the necessary peripheral force acts on the bobbin revolver for all the package diameters occurring in the bobbin-changing position of this winding machine and for the different package weights attributable thereto. It has been found that the curvature thus established for the cam surface retains its validity and effectiveness even when it is not a relatively large or relatively small package diameter, but another specific weight of the filament material being wound into package form, that is responsible for a relatively heavy or light package weight. To this end, all that is necessary is to modify the force applied by the power store proportionally to the change in the specific weight. In cases where springs are used as power stores, it would be necessary for this purpose to change the springs at all the winding positions of the machine. In order to be able with advantage centrally to adapt all the winding positions for winding a filament material with a different specific weight from the previously wound filament material, it is desirable to use a piston-and-cylinder assembly which are charged with an air pressure proportional to the specific package weight as the power store.

Embodiments of the invention are described by way of example below with reference to the accompanying drawings, wherein.

Figure 3C:
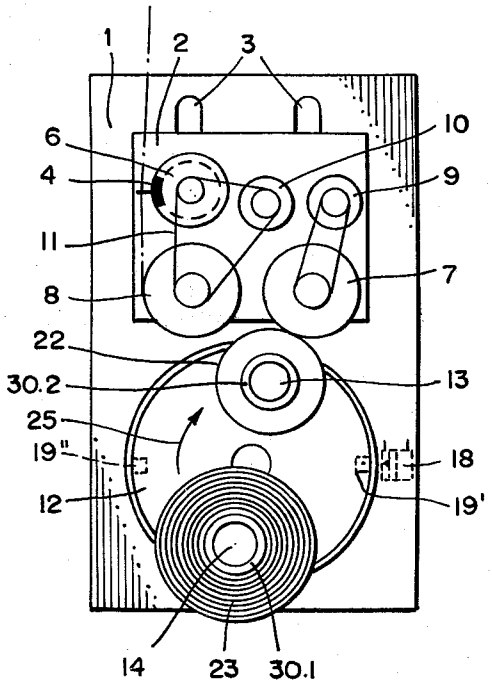
Figure 3B:
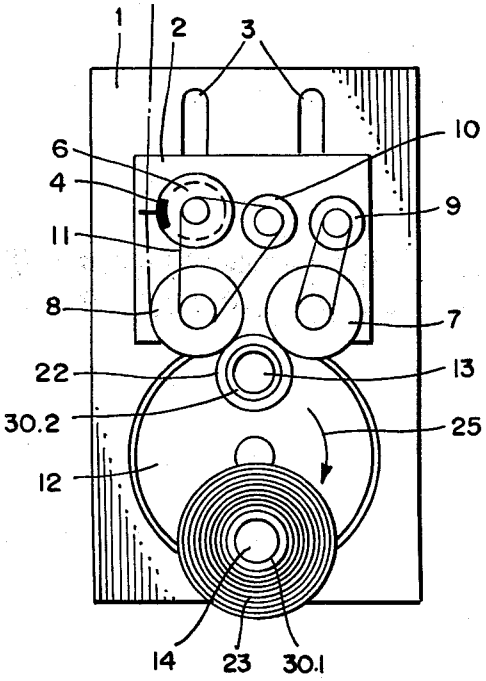
Figure 3A:
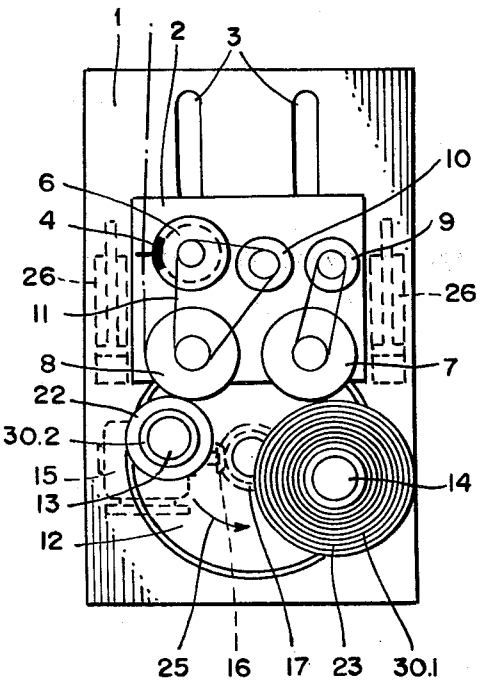
Figure 4A:
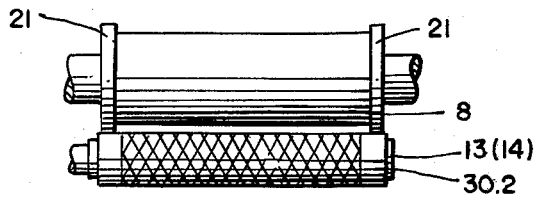
Figure 4B:
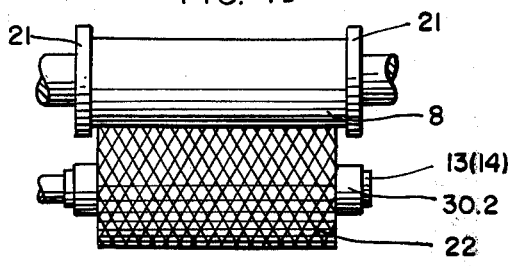
Figure 5A:
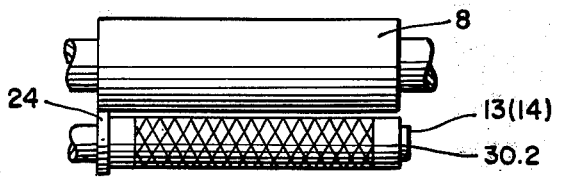
Figure 5B:
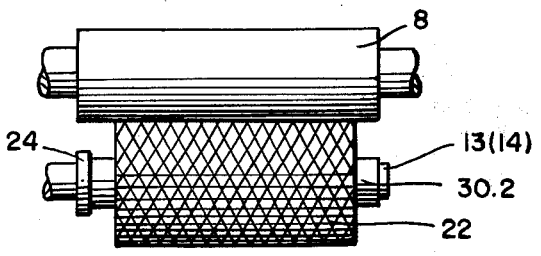

FIGS. 3*a* and 3*c* diagrammatically illustrate individual working phases of the winding machine;

FIGS. 4*a* and 4*b* are side elevations of another embodiment of the second contact roller having two empty tube-contacting rings in engagement with the winding tube at the initiation of the winding and with the winding package, respectively;

FIGS. 5*a* and 5*b* are side elevations of a further embodiment of the second contact roller in engagement with a ring on the winding tube chuck at the initiation of the winding and with the winding package, respectively.

Figure 6:
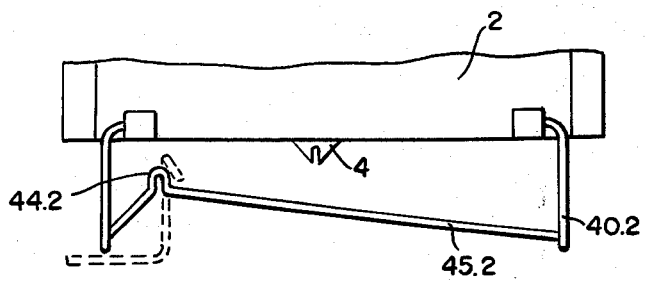

FIG. 6 is a plan view of the filament guide assembly

Figure 7:
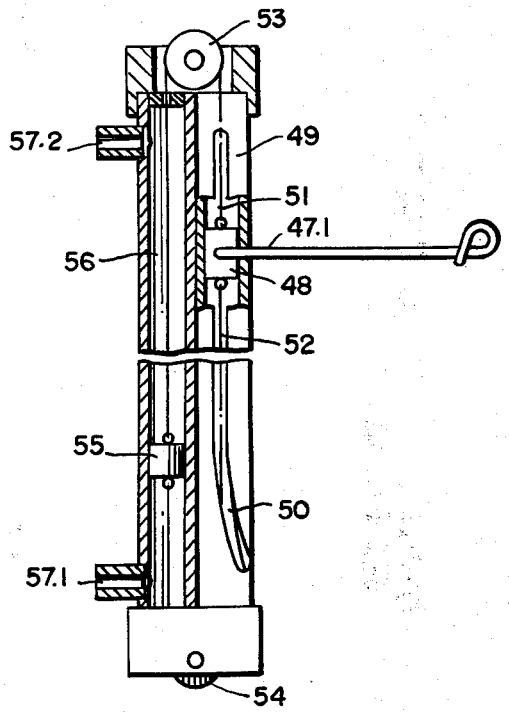
Figure 8:
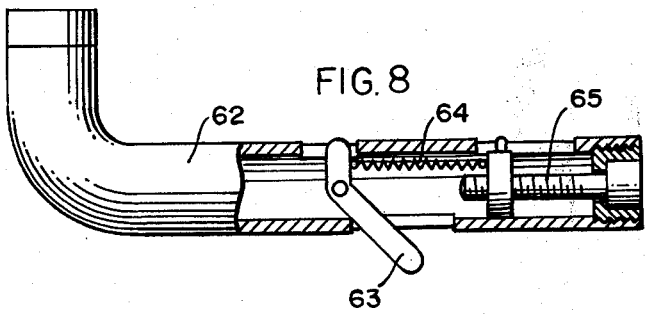

FIG. 7 is a view, partly in longitudinal section, through the cable cylinder with the filament guide track machined into it for the movement of the auxiliary filament guide;

FIG. 8 is a longitudinal section through the filament guide for forming the filament "tail;"

Figure 2:
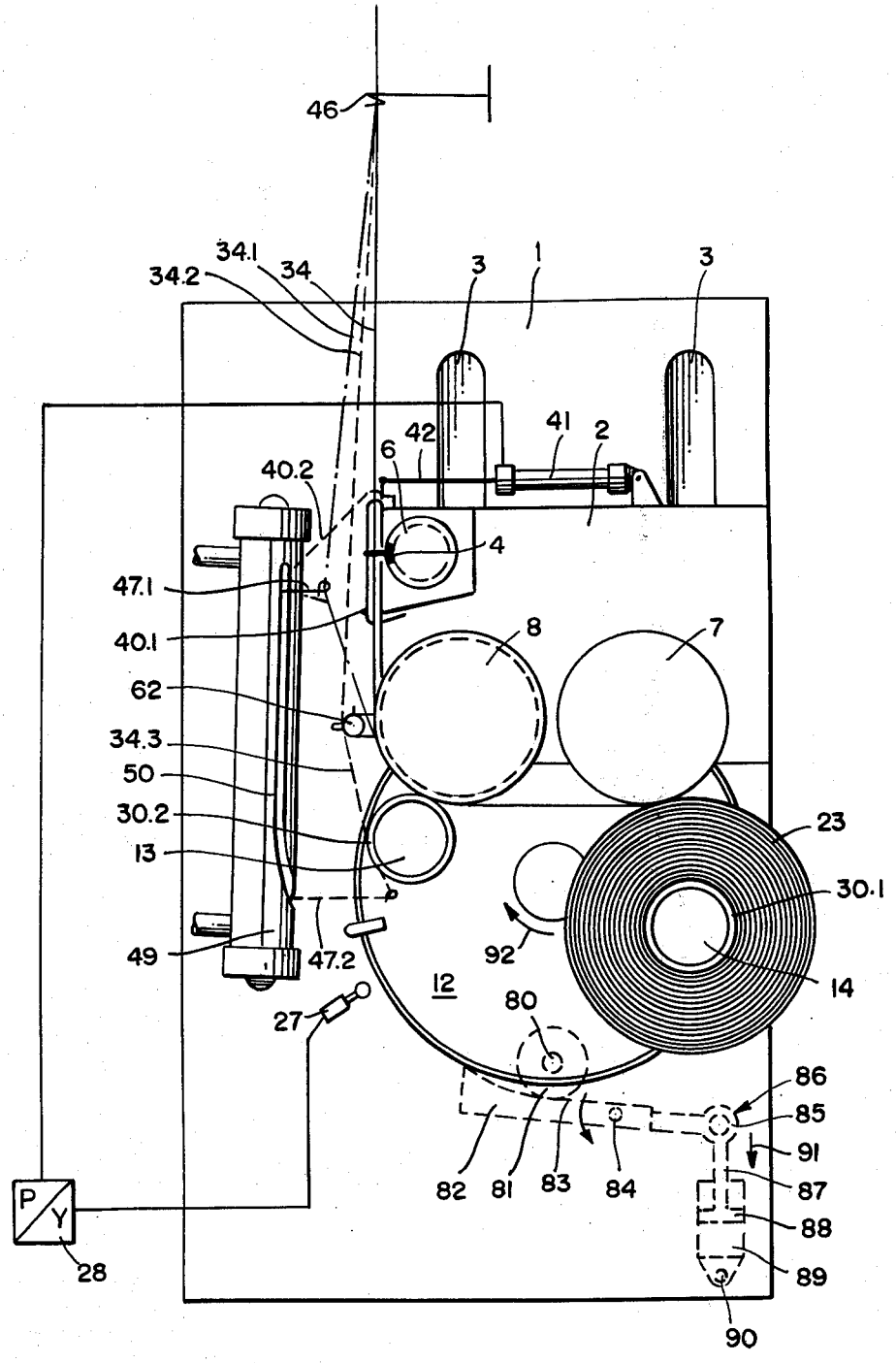
FIG. 2 is a side elevation of the winding machine.
Figure 9:
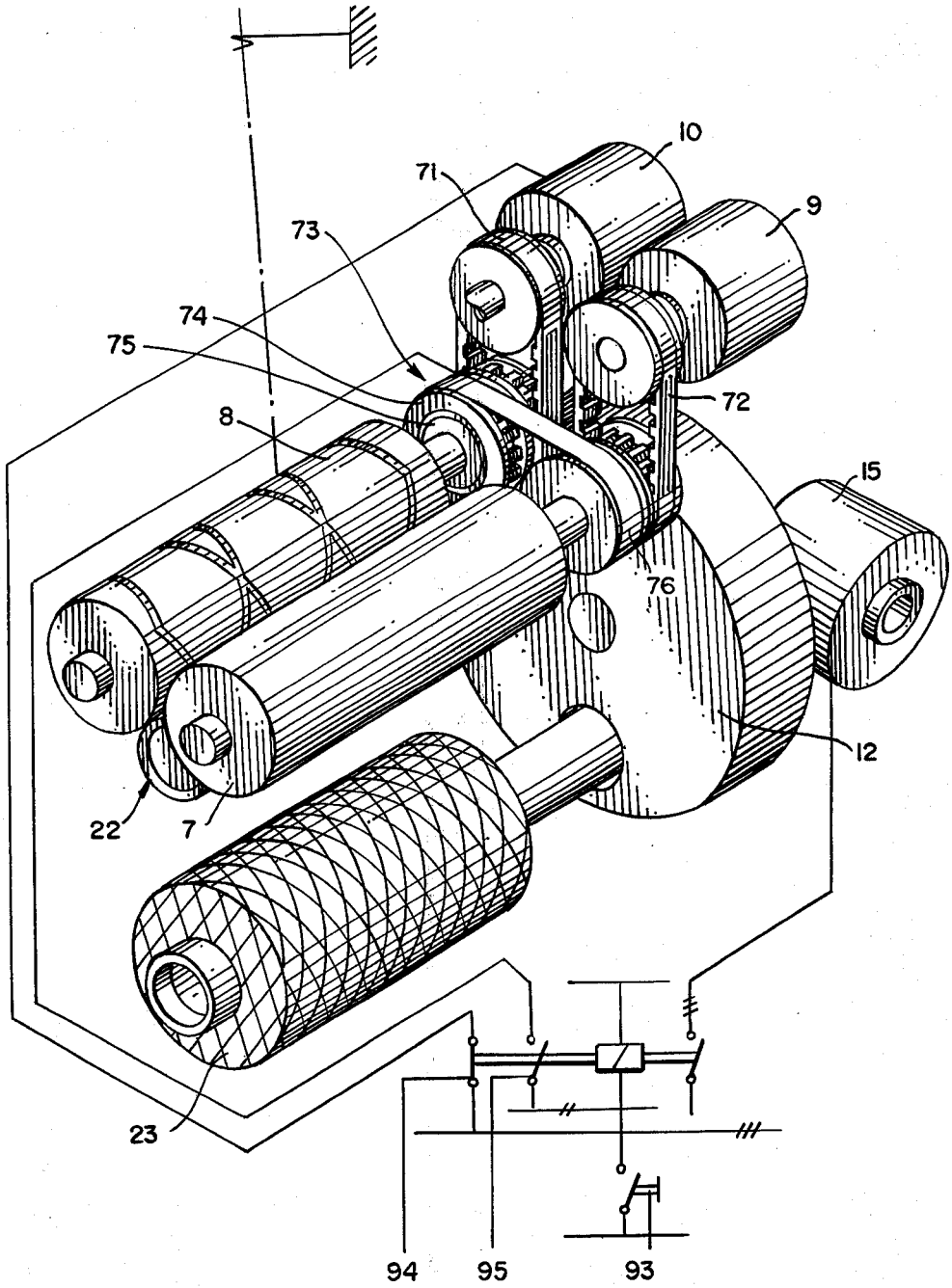
Figure 10:
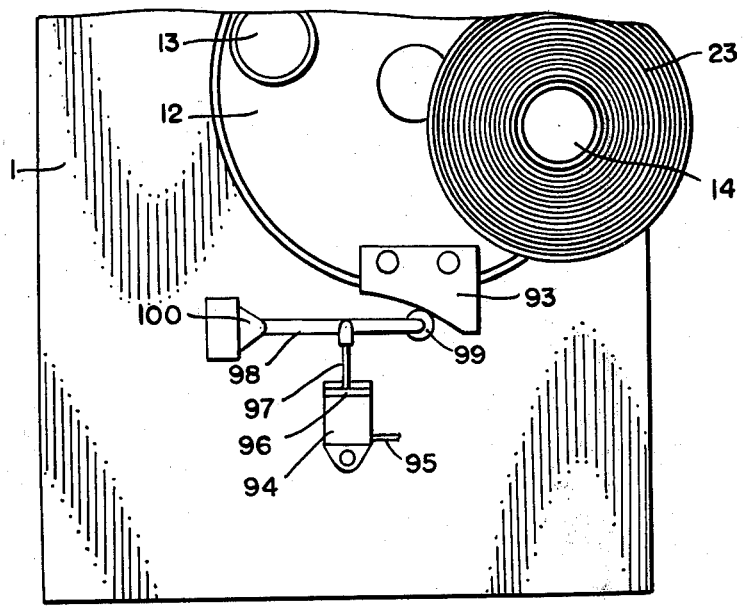
Figure 11:
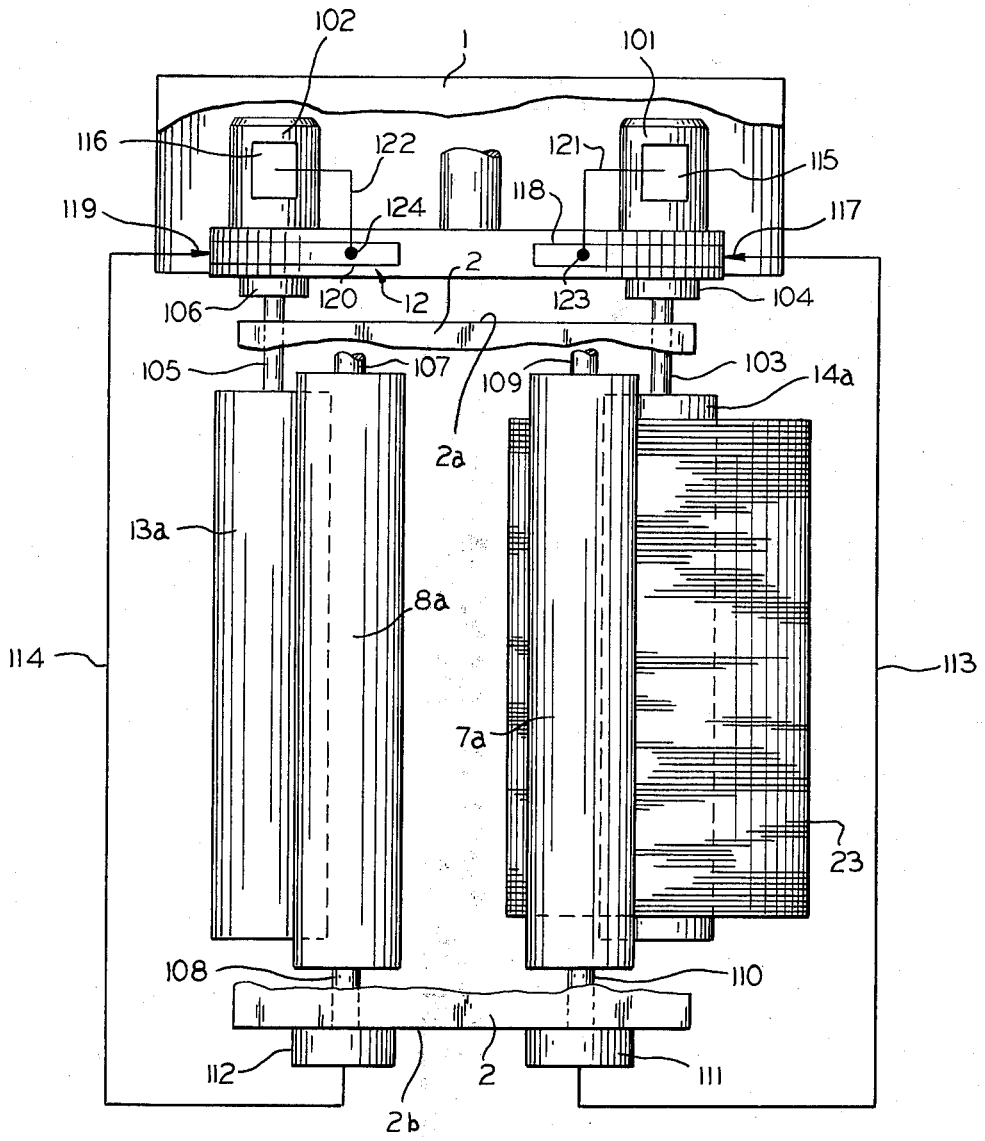

FIG. 9 is an elevation of the winding machine (partly opened) with drive systems;

FIG. 10 is a partial elevation of a modification of the embodiment of FIG. 2; and FIG. 11 is a top plan view of an embodiment, with portions thereof broken away, wherein one or both of the contact rollers function as measuring rollers and each chuck is driven by a variable speed motor mounted on the bobbin revolver.

Figure 1:
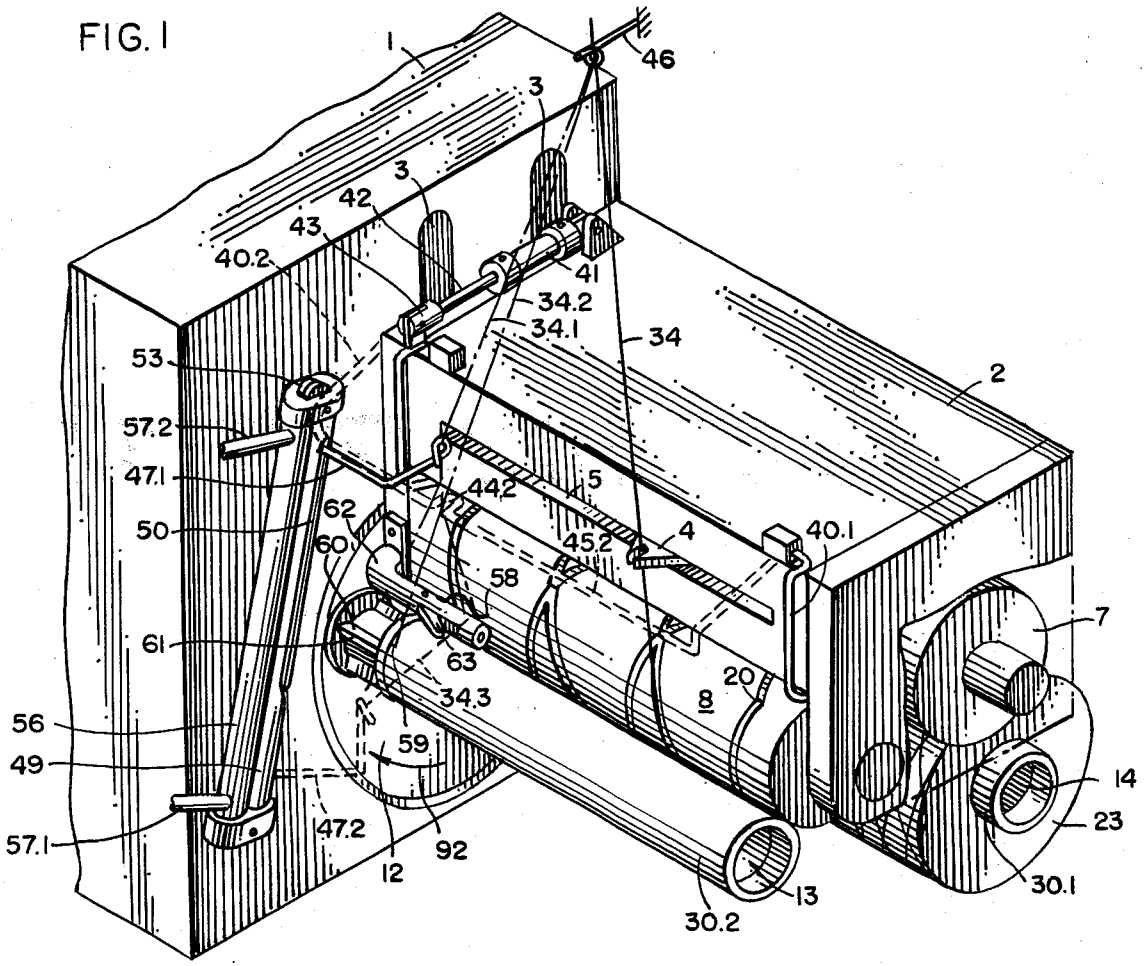
FIG. 1 is a perspective view of a winding machine.

The winding machine shown in FIG. 1 comprises a machine housing 1 connected to a machine frame (not shown) and a carriage 2 which is vertically displaceable in guides 3. The carriage 2 carries a traversing filament guide 4 which is guided in a linear guide slot 5 and which is driven by a reversing thread roller 6 shown in FIGS. 2 and 3, and also a first contact roller 7 and a second contact roller 8. As shown in FIG. 9, the first contact roller 7 is driven by a synchronous motor 9, and the second contact roller 8 is driven by an asynchronous motor 10. The reversing thread roller 6 and the second contact roller 8 are connected together by a gear belt 11 (see FIG. 3).

The winding machine comprises a bobbin revolver 12. Two chucks 13 and 14 are mounted for rotation on the bobbin revolver 12. The bobbin revolver is rotated by the revolver drive motor 15, shown diagrammatically in FIG. 3, through bevel gears 16, 17. Other drive elements, for example a clutch, can be included between the motor and the gear system. A locking mechanism 18 is also provided for locking the revolver in two predetermined working positions 19′ and 19″. The chucks 13 and 14 are arranged on chuck shafts and are designed to hold package supports such as, for example, suitable empty tubes. Suitable tube chucks are known, for example, from German Offenlegungsschrift No. 2,106,493.

In one preferred embodiment of the winding machine, the second contact roller 8 is provided with a filament guide groove 20. Since the reversing thread roller 6 and the second contact roller 8 are driven at a synchronous peripheral speed, the traversing filament guide 4 is used for guiding the filament into the guide groove 20. To this end, the reversing thread roller 6 is adapted to the second contact roller 8 in such a way that the traversing filament guide 4 guides the filament safely into the guide groove with sufficient lead. The filament guide groove 20 takes over the actual laying of the filament on the package. Particulars on the configuration of the filament guide groove can be found in German Offenlegungsschriften Nos. 2,040,479 and 2,345,898. Other embodiments of the second contact roller are shown in FIGS. 4*a*, 4*b*. In FIGS. 4*a* 4*b*, the second contact roller 8 comprises rings 21 adapted to drivingly engaged the empty tube 22 of the tube chuck 13, 14. After a few layers of filament have been wound onto the empty tube 22, the package 23 in the process of winding comes into contact with the contact roller 8, so that the rings 21 become inoperative. In FIGS. 5*a* and 5*b* the chuck is provided with a ring 24 which initially is in contact with the contact roller 8 until a few layers of filament have been wound on to the empty tube and package 23 in the process of winding comes into contact with the contact roller. The ring 24 then becomes inoperative. In every case, the object of the second contact roller according to the invention is to ensure that the filament can be traversed in the required manner until the empty tube, in contact with the second contact roller 8 during filament change, has been accelerated to the peripheral speed of the second contact roller so that the filament can then be transferred from the full package to the empty tube (as is described below).

Before further details of the winding machine are discussed, its working phases will first be described with reference to FIGS. 2 and 3*a*, 3*b* and 3*c*. In FIG. 2, a full package 23 is in contact with the first contact roller 7, while an empty package 30.2 is in contact with the second contact roller 8. In this working phase, the chuck 13 with the empty tube 30.2 is accelerated to the peripheral speed of the second contact roller 8. At this momemt, the full package 23 is still receiving filament. In this phase of operation, the filament guide grooves 20 (FIG. 1) or the design of the contact roller with collars (FIG. 4*a* and 4*6*) or the design of the chuck with a collar (FIG. 5*a* and 5*b*), ensures that the filament can still be moved freely back and forth between the empty tube and the second contact roller, enabling the package 23 to continue being built up without interference.

When the empty tube 30.2 has reached the peripheral speed of the second contact roller 8, the filament transfer means which are described below are brought into operation, the filament applied to the empty tube 30.2 and, at the same time, separated from the full package 23. As shown in FIG. 3*a*, the tube 30.2 is now wound with filament to form the package 22, for which purpose the bobbin revolver 12 is rotated through a predetermined angle in the direction of the arrow 25. In this phase of operation, the revolver drive 15 is not operative so that the revolver is freely rotatable under the contact forces of the contact rollers 7, 8 and the increasing diameters of the packages 23 and then 22 (FIG. 3*b*).

After the working phase shown in FIGS. 2 and 3*a*, which only lasts a short time, the revolver drive motor is switched on and the bobbin revolver rotated. As shown in FIG. 3*b*, the package 22 in the process of winding can come briefly into contact with both the contact rollers 7, 8 at the same time, depending upon the interval between and diameter of the two contact rollers. The bobbin revolver is rotated until it is locked in the working position 19' shown in FIG. 3*c* by the locking mechanism 18. The package 22 in the process of being wound is now in contact with the first contact roller 7, while the full package 23 is removed and can be replaced by a new empty tube.

As shown in FIGS. 2, 3*a*, 3*b*, 3*c*, the carriage 2 makes a vertical movement during rotation of the bobbin revolver 12 and during the winding cycle. The pneumatic supporting assemblies 26 are provided for the vertical upward and downward movement, being charged with compressed air in such a way that they compensate all or part of the weight of the carriage and, optionally, generate an additional contact pressure between the contact rollers and the tubes or packages in contact with them.

The following description of the means for applying the filament refers in particular to FIGS. 1 and 2. The filament transfer system is switched on by a time relay 27 which is brought into operation when the button revolver 12 rotates into the position shown in FIG. 2. The time relay 27 is set in such a way that, by the time it emits a switching pulse the empty tube 30.2 has reached the necessary peripheral speed of the second contact roller 8. The switching pulse from the time relay is transmitted to a voltage/pressure converter 28 and thence to a pneumatic cylinder 41. This causes the filament guide assembly 40.1 to swing out of its starting position (solid lines) into the traversing plane between the reciprocating filament guide 4 and the second contact roller 7 and also into the end position denoted by the chain-line of the filament guide assembly which, in this position, is denoted by the reference 40.2. At the same time, the cylinder 41 lifts the filament 34 out of the traversing fliament guide 4. The pivoting movement is obtained by admitting compressed air to the pneumatic cylinder 41 whose piston rod 42 is fixed to the filament guide assembly by means of a pivot 43. The stroke of the piston rod 42 determines the end positon 40.2 and the starting position 40.1 of the filament guide assembly. The stroke is such that, in its starting position, the filament guide assembly is as it were sunk behind the traversing plane in the carriage 2 of the winding head. When the filament 34 has been lifted out of the traversing filament guide 4, it is automatically pulled to the middle of the traversing stroke under the effect of the tension prevailing in it, and due to the inclined position of the filament guide assembly relative to the second contact roller 8 slides along on oblique plane to the angled part 44.2 of the filament guide assembly at the end of the traversing stroke. The inclined plane extends between that part 45.2 of the filament guide assembly 40.2 which is inclined towards the winding axis and the filament guide 46 fixed to the machine frame. As it slides along the filament guide assembly 40.2 towards the angled part 44.2 thereof, the filament is supported by the filament guide groove 20 in the second contact roller 8.

An auxiliary filament guide 47.1 cooperates with the filament guide assembly 40.2 in its swung-out position. In its starting position shown in solid lines, this auxiliary filament guide 47.1 takes over the filament travelling towards the package when the filament guide assembly is returned to its starting position 40.1 by the admission of compressed air to the cylinder 41. The path which the filament follows in this respect is shown in chain-dot lines in the drawing and is denoted by the reference 34.1. The auxiliary filament guide 47.1 is fixed to the piston 48 (not shown in detail in FIG. 7) which is guided in a cable cylinder 49. It moves along a guide track 50 which is machined into the wall of the cable cylinder. The piston 48 is attached to cables 51 and 52 which are guided over guide rollers 53 and 54 and which are fastened to the piston 55 of the double-acting pneumatic cylinder 56. By the controlled admission of compressed air to the pneumatic cylinder 56 through the line 57.1, the auxiliary filament guide 47.1 is displaced along the guide track 50. It pulls the filament 34.1 through a piece of wire 58, bent substantially in the form of a Z, which projects into the path of the filament and forms from the filament a loop which is opened as the auxiliary filament guide 47.1 continues its travel along the guide track 50. The length of filament delivered by the auxiliary filament guide 47.1 to the almost full package 23 slides down along the oblique part of the wire 58 into the position 34.3 shown in chain lines, while that length 34.2 of the filament travelling from the fixed filament guide 46 to the auxiliary filament guide 47.2 is brought into contact with a filament catch 59 on the empty tube 30.2 by the rotation of the auxiliary filament guide attributable to the shape of the guide track 50 in the cable cylinder 49. The filament 34.2 is automatically picked up by the empty tube and that length of filament between the filament catch 59 and the auxiliary filament guide 47.2 (chain-line end position) is brought into the range of cutters 60. The cutters 60 are in the form of prismatic bodies distributed around the periphery of each chuck shaft. The edges of the cutters which run parallel to the axis of the chucks are in the form of cutting edges 61. In this way, the filament which is now trapped in the filament catch 59 and continues to be wound on to the full package 23 has increased tension imparted to it and is cut by the cutters 60. By admitting compressed air into the line 57.2, the auxiliary filament guide is then returned to its starting position 47.1 where it remains until the next bobbin change.

In the meantime, the filament 34.2 caught by and travelling on to the empty tube 30.2 tends to move back towards the middle of the traversing stroke under the effect of the tension prevailing in it. However, it is prevented from doing so by the fixed filament guide 62 which is mounted on the carriage 2 of the winding head and which projects into the plane of filament travel between the fixed filament guide 46 and the empty tube 30.2. The filament guide 62 is shown in detail in FIG. 8. It is provided with a pin 63 which is laterally deflected under an adjustable spring force. The spring 62 is adjusted by means of a socket head cap screw 65 introduced into the tubular filament guide 62. While the resistance is being overcome by the laterally deflected pin, the tail is applied with a delay in the movement of the filament towards the middle of the traversing stroke. The filament is then immediately pulled towards the middle of the traversing stroke where it is picked up by the traversing filament guide 4 and laid in proper fashion to form a crosswound cheese. The described filament guide 62 with the cocked pin 63 for forming the tail on the empty tube is preferably used for winding heavy-duty filaments, more especially carpet-grade yarn, because in this case it is possible to apply higher filament forces to move the pin 63 (against the force of the spring) than is possible with textile filaments of lower denier.

FIG. 9 illustrates the drive of the winding machine according to the invention. The first contact roller 7 is driven at a constant speed of rotation by the synchronous motor 9 and gear belt 72. The second contact roller 8 is driven by a motor 10, which may be a synchronous or asynchronous motor, and by gear belt 71. The reversing thread shaft and the traversing filament guide 4 illustrated in FIG. 1 have been omitted from FIG. 9 in the interests of clarity. In this connection, it is pointed out that, where the second contact roller 8 is formed with filament guide grooves, it is not absolutely essential for the filament to be traversed by a reversing thread shaft and traversing filament guide.

A clutch 73 is fixed to the shaft of the second contact roller 8, its outer ring 74 being connected by a belt 76 to the drive shaft of the first contact roller 7. FIG. 9 shows the working phase in which the bobbin revolver 12 has been pivoted to just such an extent that the tube 22 being wound is in simultaneous contact with the first and second contact rollers. It has proved to be of particular advantage to drive the first and second contact rollers at the same time peripheral speed at this particular moment in time. As already mentioned, the second contact roller 8 can be driven at a higher or lower peripheral speed than the first contact roller 7. Filament tension can be favorably influenced in this way. The first contact roller 7 advantageously has a certain lead over the second contact roller 8. In order to establish the same peripheral speed for both contact rollers, the rotational speed of the drive motor 10 is reduced or increased and the clutch 73 is engaged. In one preferred embodiment, the clutch 73 is an overriding clutch which automatically comes into operation when the rotational speed of the motor 10 is reduced, and imparts to the second contact roller 8 through the belt 76 a minimum rotational speed adapted to the rotational speed of the first contact roller 7. It is possible to use conventional types of overriding clutch (cf. for example Kollmann: Beitrag zur Konstruktion und Berechung von Uberholkupplungen in "Konstruktion" 1957, pp. 254 et seq; Bostiber & Kingston: Free-wheeling Clutches in "Machine Design" 24 (1952), No. 4, pp. 189 – 194.

The direction in which the overriding clutch acts depends on which of the two contact rollers is leading or trailing. In either case, the contact roller 7 should be connected to the synchronous motor and driven at a constant speed, even during the change-over phase.

On completion of filament change (cf. FIG. 2 and corresponding description), the bobbin revolver 12 is brought into operation by a switch 93. At the same time, the rotational speed of the motor 10 is reduced or the motor 10 switched off altogether by the switch 93 and a magnetic switch 94, and the clutch 73 switched on by a magnetic switch 95. The second contact roller 8 is then driven by the synchronous motor 9 so that the two contact rollers 7, 8 have the same peripheral speed. If the clutch 75 is in the form of an overriding clutch the magnetic switch 95 is left out. In this case, the contact roller 8 is automatically entrained by the motor 9 when the motor 10 is switched off.

FIG. 2 shows an arrangement which prevents the bobbin revolver 12 from continuing to rotate under the weight of the full package 23. This arrangement is desirable because the force acting on the empty tube under the gravity of the full package substantially coincides with the direction of movement of the carriage 2. In the present case, the bobbin revolver 12 carries a cam in the form of a roller 81 rotatable about the spindle 80. Corresponding to the number of tube chucks 13, 14, the bobbin revolver 12 comprises two rollers 80, 81 which are offset through 180° relative to one another and which alternately cooperate with the cam surface 83. In the interests of simplicity, however, only one of the two rollers 80, 81 is shown. The pivotal lever 82 is connected through a joint 85 to a power store 86 which can be, for example, in the form of a spring. In the present case, the power store 86, for reasons which have already been mentioned, comprises a piston rod 87, a piston 88 and a cylinder 89. Air can be admitted to the piston-and-cylinder assembly under different, adjustable pressures. The cylinder 89 is arranged to pivot about a pin 90. The compressed air is admitted in the direction of the arrow 91 in such a way that the cam surface 83 is pressed against the roller 81. The pressure arriving at the cylinder 89 can be varied through a line (not shown in detail).

Before the details of the operation of this arrangement for compensating the weight of the full package during the filament-changing operation are discussed, a few working phases in the winding operation will first be discussed to enable the arrangement to be more clearly understood. Before the package denoted by the reference 23 in FIG. 2 moved into the working phase shown in that Figure, it was wound to its predetermined diameter in the position in which the package 22 is situated in FIG. 3*c*. In this position, the bobbin revolver 12 was locked against rotation by the locking mechanism 18. After the package had reached its predetermined diameter, the locking mechanism was released, the revolver drive 15, 16, 17 brought into operation and at the same time pressure medium, for example compressed air, admitted to the piston 88 in the cylinder 89. The bobbin revolver 12 was rotated in the direction indicated by the arrow 92 (FIG. 2) by the drive 15, 16, 17. At the same time, the carriage 2 followed the package 23 (radially of the bobbin revolver because the contact roller 7 rested on the package 23 under the influence of the carriage weight, part of the carriage weight being compensated by the pneumatically operated supporting unit 26 (FIG. 3*a*). With the clearance between the empty tube 30.2 and the contact roller 8 down to a few millimeters, the drive motor 15 was stopped and a clutch optionally present in the drive of the bobbin revolver released. At this state, the roller 81 and cam surface 83 were already in working contact, so that the bobbin revolver 12 would be further rotated under the effect of the weight of the package 23 through the simultaneous contact of the empty tube 30.2 with the contact roller 8 and of the full package 23 with the contact roller 7 where the effect of this weight not counteracted by the peripheral force applied by the unit 80 – 90 to the bobbin revolver. These oppositely directed forces are compensated in such a way that, when the position shown in FIG. 2 is reached, the contact forces applied to the empty tube 30.2 and the package 23 are strong enough both to accelerate the empty tube 30.2 to continue driving the package 23 until the empty tube 30.2 has reached its predetermined speed and the filament has been applied to the empty tube 30.2 and cut between the empty tube 30.2 and the package 23.

After a few layers of filament have been wound on to the tube 30.2 and, hence, friction contact established between the growing package 22 and the contact roller, the drive link to the bobbin revolver is re-established and the pressure in the cylinder 89 released again. While the bobbin revolver 12 rotates clockwise, the working connection between the cam surface 83 and the roller 81 eliminated by the release of pressure is broken. When the package 22 reaches the winding position shown in FIG. 3c, the locking mechanism 18, 19' and 18, 19'' automatically engages immediately after the motor 15 has been switched off.

If, after winding a certain package, it is desired to produce another package different in weight from the first, even although the difference in weight arises out of the different specific weight of the filament material and not out of a difference in the final package diameter, the cam surface 83 does not have to be changed. Instead, all that has to be done is to alter the pressure for the pressure medium admitted to the piston 88 in the cylinder 89, for example by way of a pressure-reducing valve in the pneumatic system, proportional to the change in the specific weight. In other words, if it is desired to produce packages from a certain fliament material whose specific weight is higher to a certain extent than that of the filament material of which the package previously wound on the same winding machine consisted, the air pressure acting in the cylinder 89 has to be increased in the same ratio as the ratio between the two specific weights in question.

The weight compensating system shown in FIG. 10 functions on the same principle as the embodiment already described in reference to FIG. 2. In contrast to the embodiment illustrated in FIG. 2, the cam surface denoted by the reference 93 is on the bobbin revolver 12 in the arrangement shown in FIG. 10. The cylinder 94 connected to a pneumatic system (not shown) through a compressed air line 95 is connected to the fixed machine housing 1. The piston rod 97 fixed to the pneumatically operated piston 96 acts on a lever 98 which, at its free end, carries a freely rotatable roller 99 resting on the cam surface 93 and which is pivotally connected at 100 to the fixed machine frame.

The freely rotatable roller 99 is preferred to a cam sliding on the cam surface 93 because it has been found that force and opposing force can be compensated with the greatest degree of reliability at the bobbin revolver when the friction between the cam surface 93 and the component acting on it is kept as low as possible. Corresponding to the number of tube chucks, the bobbin revolver comprises two cam surfaces 93 offset through 180° relative to one another on its periphery.

The embodiment of FIG. 11 corresponds in most respects to the earlier described embodiments. The essential difference is that both embodiments. The essential difference is that both contact rollers 7a, 8a are not driven but rather are freely rotatable. They ride on the winding tube or the winding and function as a measuring roller. Alternatively, only the contact roller 7*a* may be a measuring roller while contact roller 8*a* is a grooved, driven roller like the roller 8 and functions as part of the traverse system in FIG. 1. In both cases, the chucks 13*a* and 14*a* are driven by variable speed, electric motors 101 and 102 which are mounted on the bobbin revolver 12.

FIG. 11, for sake of simplification in illustrating the aforesaid differences, omits many components of the overall winding machines shown in FIGS. 1–10, viz., the traversing guide 4, the filament transfer system previously described with reference to FIGS. 1 and 2, the filament cutters 60 on the chucks, the cam-roller system 81–91 in FIG. 2, and the bobbin revolver's drive motor and gears.

In FIG. 11, the illustrated carriage 2 is broken away—only its opposite end wall portion 2*a* and 2*b* being shown. The electric motor 101 rotatably drives the chuck 14*a* via the chuck axle 103 which is rotatably journalled in the bearing 104. The electric motor 102 rotatably drives the chuck 13*a* via the chuck axle 105 which is rotatably journalled in the bearing 106. Motors 101, 102 and the bearings 104, 106 are mounted on the bobbin revolver, the shaft 12*a* of which is driven by gears and the motor 15 as illustrated in FIG. 3.

The contact rollers 7*a* and 8*a* each may have their shafts or axles 107–110 rotatably freely journalled in the opposite end wall portions 2*a* and 2*b* of the carriage 2. The contact rollers thus rotate when they are in contact with a winding tube rotate when they are in contact with a winding tube or the winding 23 on such tube at the same peripheral speed as that of the tube or winding.

When functioning as measuring rollers, the rate of rotation of the contact rollers is measured electrically by the sensor units 111 and 112, respectively, their electrical signals being transmitted by wires 113, 114 to the speed regulating units 115, 116 of the motors 101, 102. Any suitable electrical connections which take into account the orbiting of motors 101, 102 when the revolver 12 rotates may be used.

Suitable electrical connections are shown schematically in FIG. 11 wherein the wire 113 has a brush or sliding contact 117 with a condective band 118 encircling part of the periphery of the revolver, e.g., an arc 90°–120°, and the wire 114 has a brush or sliding contact 119 with another conductive band 120 likewise encircling part of the periphery of the revolver. The units 115 and 116, respectively, have wires 121 and 122 fixedly joined at 123, 124 to the respective conductive rings 118 and 120. When the revolver 12 has rotated 180°, the circuits via 113, 117, 118, 121 and via 114, 119, 120, 122 are broken. A new circuit via 113 117, 122 and band 120 is established between sensor unit 111 and motor 102. Similarly, another new circuit is established between sensor unit 112 and motor 101 via 114, 119, 121 and band 118.

Specific forms of the contact roller-motor speed regulating systems shown diagrammatically as parts 111, 115 and 112, 116 are well known in the art, e.g., in German Pat. No. 1,115,815.

Should contact roller 8*a* be a driven, grooved, filament traversing roller driven and operated like contact roller 8 in FIGS. 1–9, the regulating system units 112, 114 and 119 are omitted. The chuck drive motors 101 and 102 are wired through a switch or relay (not shown) and are respectively alternately energized as the empty tube on the chuck 13*a* or 14*a*, which rotates when its tube is in contact with the rotatably driven contact roller 8*a*, leaves the latter and reaches or approaches the winding position wherein the tube or its winding has disengaged from the rotatably driven roller 8*a* and is only in frictional contact with the freely rotatable measuring roller 7*a*.

The invention is hereby claimed as follows:

1. A winding machine comprising a traversing system, a first contact roller, a second contact roller laterally spaced from said first contact roller, the respective axes of rotation of said rollers being substantially parallel and laterally spaced, each roller being adapted to be brought into friction contact with the periphery of a winding tube or package, a rotatable bobbin revolver on which are rotatably mounted at least two tube chucks which are orbited by said revolver alternately to bring an empty tube or a winding package thereon into friction contact with a contact roller and into a bobbin changing or rest position, a drive system for each of the contact rollers, said revolver and chucks being arranged so that a substantially full winding is kept in its friction contact with the first, rotating contact roller while, at the same time, another chuck or an empty tube mounted on it is moved into friction contact with the second, a rotating contact roller, and means for transferring filament being wound on said package to the rotating empty tube after the peripheral velocity of said empty tube or its chuck has been accelerated in friction contact thereof with said second contact roller to the peripheral velocity of said second contact roller and while said substantially full winding package is still in friction drive contact with said first contact roller.

2. A winding machine as claimed in claim 1, wherein the second contact roller has one or more rings of larger diameter than the roller and adapted to engage a respective end of an empty tube mounted on a chuck.

3. A winding machine as claimed in claim 1, wherein each chuck bears a contact ring of larger diameter than the chuck and wherein the second contact roller extends sufficiently axially to engage said contact ring.

4. A winding machine as claimed in claim 1, wherein the second contact roller is a grooved roller with endless filament guide grooves in the roller's surface.

5. A winding machine as claimed in claim 1, and mechanical transmission and clutch means interconnecting the contact rollers.

6. A winding machine as claimed in claim 5, wherein said mechanical transmission and clutch means has means for driving one contact roller faster than the other contact roller, and the clutch of said means is an overriding clutch which can be brought into operation by reducing the rotational speed or driving power of the faster-rotating contact roller.

7. A winding machine comprising a traversing system, first and second, laterally spaced, contact rollers adapted to be brought into friction contact with the periphery of a winding tube or package, a rotatable bobbin revolver on which are rotatably mounted at least two tube chucks which are orbited by said revolver alternately to bring an empty tube or a winding package thereon into friction contact with a contact roller and into a bobbin changing or rest position, a drive system for each of said contact rollers, said revolver and chucks being arranged so that a substantially full winding package on one chuck is kept in its friction contact with the first contact roller while, at the same time another chuck or an empty tube mounted on it is moved into friction contact with the second contact roller, the contact rollers being carried by a substantially vertically displaceable carriage, and means associated with the bobbin revolver on the one hand and with the machine frame on the other hand and operable under the adjustable effect of a power store in such a way that a peripheral force offsetting at least some of the weight of the full package is applied to the bobbin revolver when a full package and an empty tube are simultanesouly in contact with the contact rollers.

8. A winding machine as claimed in claim 7, wherein the power store is a pneumatically operated piston-and-cylinder assembly.

9. A winding machine as claimed in claim 7, wherein said means includes a cam surface on the arm of a lever whose pivot is fixed to the machine frame and to which said power store is pivotally connected.

10. A winding machine as claimed in claim 8, wherein said means includes a cam surface on the bobbin revolver and also a roller riding on the cam surface, which roller is operatively associated with a piston rod of said piston-and-cylinder assembly, which is mounted on the fixed machine frame.

11. A winding machine comprising a filament traversing system, a first contact roller, a second contact roller laterally spaced from said first contact roller, the respective axes of rotation of said rollers being substantially parallel and laterally spaced, the second contact roller being a component of said filament traversing system and being a grooved roller with endless filament guide grooves in the roller's surface, each roller adapted to be brought into friction contact with the periphery of a winding tube or package, a drive system for each of the contact rollers, at least two tube chucks, shiftable means associated with said tube chucks to bring an empty tube or winding package thereon alternately into friction contact with a contact roller and into a bobbin changing or rest positon, and said means and chucks being arranged so that a substantially full winding package on one chuck is kept in its friction contact with the first contact roller while, at the same time, another chuck or an empty tube mounted on it is moved into friction contact with the second contact roller to cause said empty tube and its chuck to rotate.

12. A winding machine as claimed in claim 11, wherein the second contact roller has one or more rings of larger diameter than the roller and adapted to engage a respective end of an empty tube mounted on a chuck.

13. A winding machine as claimed in claim 11, wherein each chuck bears a contact ring of larger diameter than the chuck and wherein the second contact roller extends sufficiently axially to engage said contact ring.

14. A winding machine as claimed in claim 11, and mechanical transmission and clutch means interconnecting the contact rollers.

15. A winding machine as claimed in claim 11 where said shiftable means is a bobbin revolver having said chucks mounted thereon for orbital movement as said revolver rotates, the contact rollers being carried by a substantially vertically displaceable carriage, and means associated with the bobbin revolver on the one hand and with the machine frame on the other hand operable under the adjustable effect of a power store in such a way that a peripheral force offsetting at least some of the weight of the full package is applied to the bobbin revolver when a full package and an empty tube are simultaneously in contact with the contact rollers.

16. A winding machine as claimed in claim 15, wherein said means includes a cam surface on the arm of a lever whose pivot is fixed to the machine frame and to which said power store is pivotally connected.

17. A winding machine as claimed in claim 16, wherein said means includes a cam surface on the bobbin revolver and also a roller riding on the cam surface, which roller is operatively associated with a piston rod of said piston-and-cylinder assembly, which is mounted on the fixed machine frame.

18. A winding machine comprising a filament traversing system, a first contact roller, a second contact roller laterally spaced from said first contact roller, the respective axes of rotation of said rollers being substantially parallel and laterally spaced, each roller adapted to be brought into friction contact with the periphery of a winding tube or package, at least two tube chucks, separate, variable speed drive motors respectively coupled to each chuck, shiftable means associated with said tube chucks to move each chuck successively into a start-up position with contact between said chuck or an empty winding tube mounted thereon and said second contact roller, then into winding position with contact between the winding on said chuck and said first contact roller, and then into a bobbin changing or rest position, said means and chucks being arranged so that a substantially full winding package on one chuck is kept in its friction contact with the first contact roller while, at the same time, another chuck or an empty tube mounted on it is moved into friction contact with the second contact roller and at least said first contact roller being it is driven in contact with the rotating winding at the same peripheral speed as that of the winding's periphery, said shiftable means being a bobbin revolver having said chucks mounted thereon for orbital movement as said revolver rotates, drive means for rotating said revolver, said drive means being inoperative, and said revolver being rotatable, when the winding package on said one chuck is in friction contact with said first roller and the other chuck or said empty tube mounted thereon is in friction contact with said second contact roller, and a motor speed regulating system operatively connecting said first contact roller and each variable speed motor when its chuck is in the winding position for regulating the speed of the motor in response to changes in the diameter and peripheral speed of the winding package as its diameter increases.

19. A winding machine as claimed in claim 18, said second contact roller being and said empty tube and its chuck being rotatably driving said second roller when said tube or chuck is in frictional contact with the freely rotatably second contact roller.

20. A winding machine as claimed in claim 18 and said motors being mounted on and revolvable with said bobbin revolver.

21. A winding machine as claimed in claim 18, said second contact roller being freely rotatable whereby it is driven by the tube or chuck in contact therewith when the latter is driven by its variable speed motor, and a second motor speed regulating system operatively connecting said second contact roller and each variable speed motor when its chuck is in said start-up position.

22. A winding machine as claimed in claim 21 and said motors being mounted on and revolvable with said bobbin revolver.

* * * * *

UNITED STATES PATENT AND TRADEMARK OFFICE

CERTIFICATE OF CORRECTION

PATENT NO. : 3,999,715

DATED : December 28, 1976

INVENTOR(S) : SCHIPPERS et al

It is certified that error appears in the above–identified patent and that said Letters Patent are hereby corrected as shown below:

In Column 13, Line 18, delete "a"

In Column 15, Line 28, delete "it is"

In Column 16, Line 13, after "being" insert --freely rotatable--

In Column 16, Line 14, delete "being"

In Column 16, Line 16, "rotatably" should read --rotatable--

In Column 16, Line 21, delete "freely rotatable whereby it"

In Column 16, Line 22, delete "is" ; delete "by" ; before "the" insert --at the peripheral speed of--

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*